United States Patent [19]

Fitzpatrick

[11] Patent Number: 4,914,871

[45] Date of Patent: Apr. 10, 1990

[54] METHOD FOR HONING THIN WALL GEAR PARTS

[75] Inventor: Paul Fitzpatrick, Holland, Mich.

[73] Assignee: Micromatic Textron Inc., Holland, Mich.

[21] Appl. No.: 244,540

[22] Filed: Sep. 12, 1988

Related U.S. Application Data

[60] Division of Ser. No. 516,624, Jul. 25, 1983, Pat. No. 4,680,894, and a continuation-in-part of Ser. No. 53,712, May 26, 1987, abandoned.

[51] Int. Cl.[4] ..... B24B 1/00

[52] U.S. Cl. ..... 51/290; 51/287; 51/50 R; 51/227 R; 51/236

[58] Field of Search ..... 51/290, 287, 50 R, 48 R, 51/165.93, 227 R, 236 R, 237 R

[56] References Cited

U.S. PATENT DOCUMENTS 1,111,064 9/1914 Gudmand-Hoyer ..... 51/290

1,760,587 5/1930 Drake ..... 51/237 R 2,727,342 12/1955 Kopczynski ..... 51/236

3,605,346 9/1971 Sprishevsky et al. ..... 51/290

*Primary Examiner*—Frederick R. Schmidt

*Assistant Examiner*—Robert A. Rose

*Attorney, Agent, or Firm*—Edward J. Timmer

[57] ABSTRACT

Thin wall, torque sensitive pinion gears, sun gears or other such workparts are driven in rotation in a fixture during honing of the internal diameter to minimize out-of-roundness. The fixture for honing multiple workparts at a time includes a workpart driving means having multiple workpart driving gears each meshed with a respective one of the workparts. Each workpart driving gear is mounted on a hollow rotatable bushing arranged end-to-end with respect to adjacent bushings and dog-bone shaped driver members interconnect and are drivingly received in adjacent bushings. Means is connected to one of the dog-bone shaped members to rotate same and thereby cause the workpart driver gears to rotate the workparts in unison during honing.

2 Claims, 12 Drawing Sheets

METHOD FOR HONING THIN WALL GEAR PARTS

This is a continuation of co-pending application Ser. No. 053712 filed on 5/26/87, now abandoned, and a division of application Ser. No. 516,624 filed on July 25, 1983, now U.S. Pat. No. 4680894.

FIELD OF THE INVENTION

The present invention relates to the machining of internal diameters of thin wall gear parts and, in particular, to the honing of such internal diameters wherein out-of-roundness resulting from torque created in the honing operation is minimized. A gear part fixture, honing machine and method are provided.

BACKGROUND OF THE INVENTION

The internal cylindrical diameters of many components, such as pinion gears and sun gears, are honed to provide required geometric tolerances, diameter size, surface finish and surface character. In the past, such components have been fixtured in a full floating fixture to permit the internal diameter of the component to align to the tool and allow the honing abrasive to seat itself in the bore. Thurst plates on both sides of the floating fixture have been used to overcome honing thrust from the tooling and a torque pawl has been provided to engage one outer tooth space of the component to overcome honing torque generated by the rotating tool.

To increase machine productivity, multiple full floating fixture assemblies are utilized in a stack with a single tool performing the honing operation on all of the components in a stack.

However, with certain thin wall components, the above-described fixturing arrangement was found to be less than satisfactory from the standpoint that such thin wall components were torque sensitive and generated a predictable out-of-roundness in the honing operation relative to the location of the torque pawl. There thus exists a need to provide fixturing for such workparts to minimize out-of-roundness from the honing operation.

SUMMARY OF THE INVENTION

The present invention contemplates a fixture having a means to drive such thin wall workpart as pinion gears, sun gears and others in rotation during the honing or other machining operation without adversely influencing or restricting the ability of the component to float and align to the tool.

In a typical working embodiment of the invention, the fixture includes multiple workpart positioning assemblies in stacked relation each adapted to hold an individual workpart such that the internal diameter of each part can align itself to the honing tool and workpart driving means for driving each workpart in each assembly during the honing operation without interfering with the floating of the workpart to align itself to the tool. Preferably, the workpart driving means includes multiple workpart driving gear means meshed with a respective one of the workparts in each assembly, dog-bone shaped driver means extending between adjacent assemblies and arranged in end-to-end relation to interconnect one driving gear means to the next and to transmit driving rotation from a fixture driving means coupled to one of the dog-bone shaped driver means to all the workparts during honing.

In a particularly preferred embodiment, the workpart driving gear means is mounted on a rotatable bushing means in each assembly. The bushing means has a polygonal interior bore, such as square cross-section. The dog-bone shaped driver members extend between adjacent assemblies and each has polygonal opposite ends received in driving engagement in the ends of adjacent bushing means. A radial pin means preferably interconnects the driving gear means and the bushing means between the ends of adjacent dog-bone shaped driver means.

The fixturing system of the invention thereby drives the stacked workparts in rotation during the honing operation without interfering with the floating of the workparts to align the internal diameters thereof with the tool and in effect randomizes the torque point during honing to produce workparts with internal diameters well within required roundness specifications.

DESCRIPTION OF PREFERRED EMBODIMENTS

Figure 1:
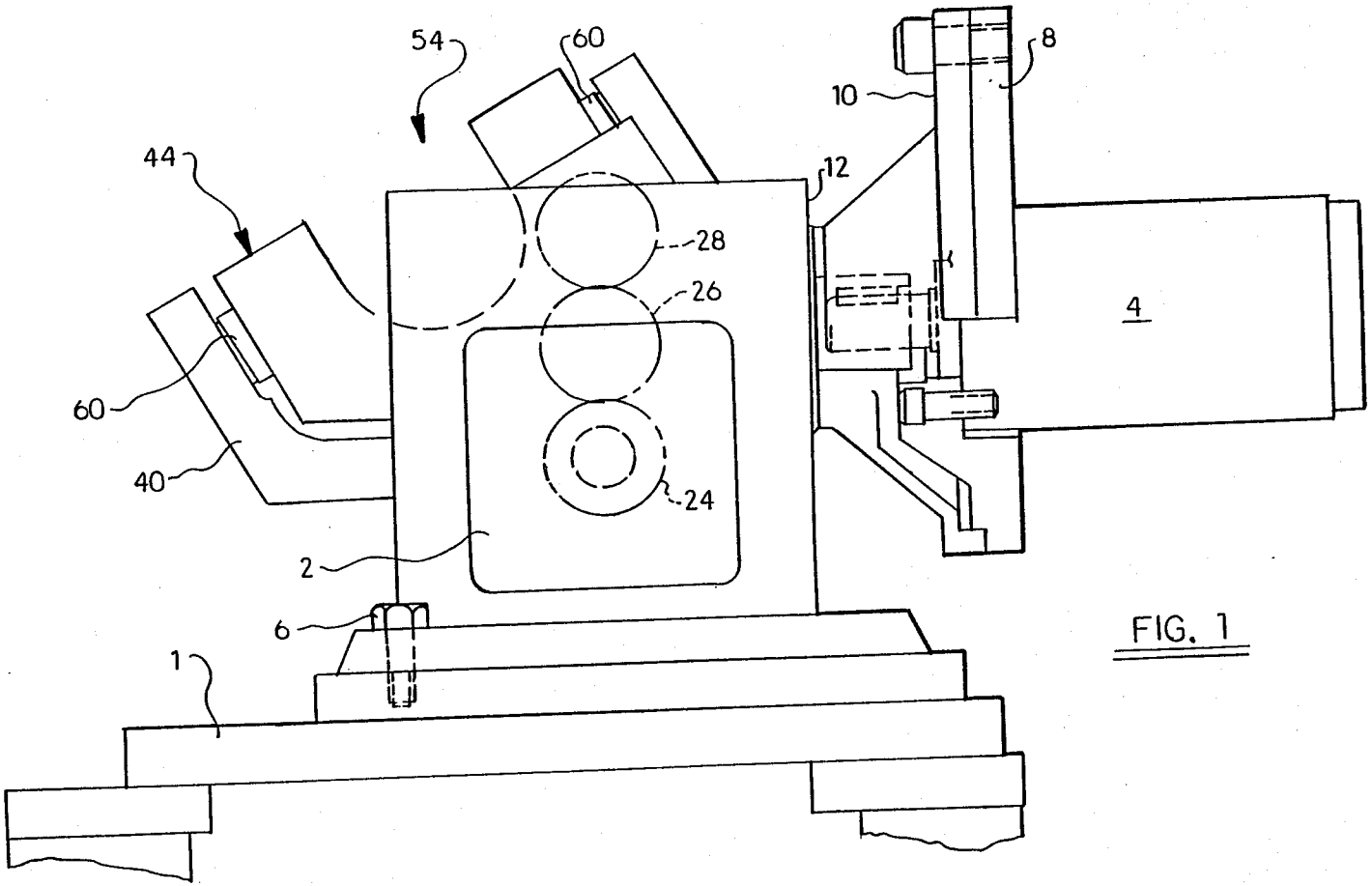
FIG. 1 is an end elevation in somewhat schematic form of a honing machine including the fixturing means of the invention.
Figure 2:
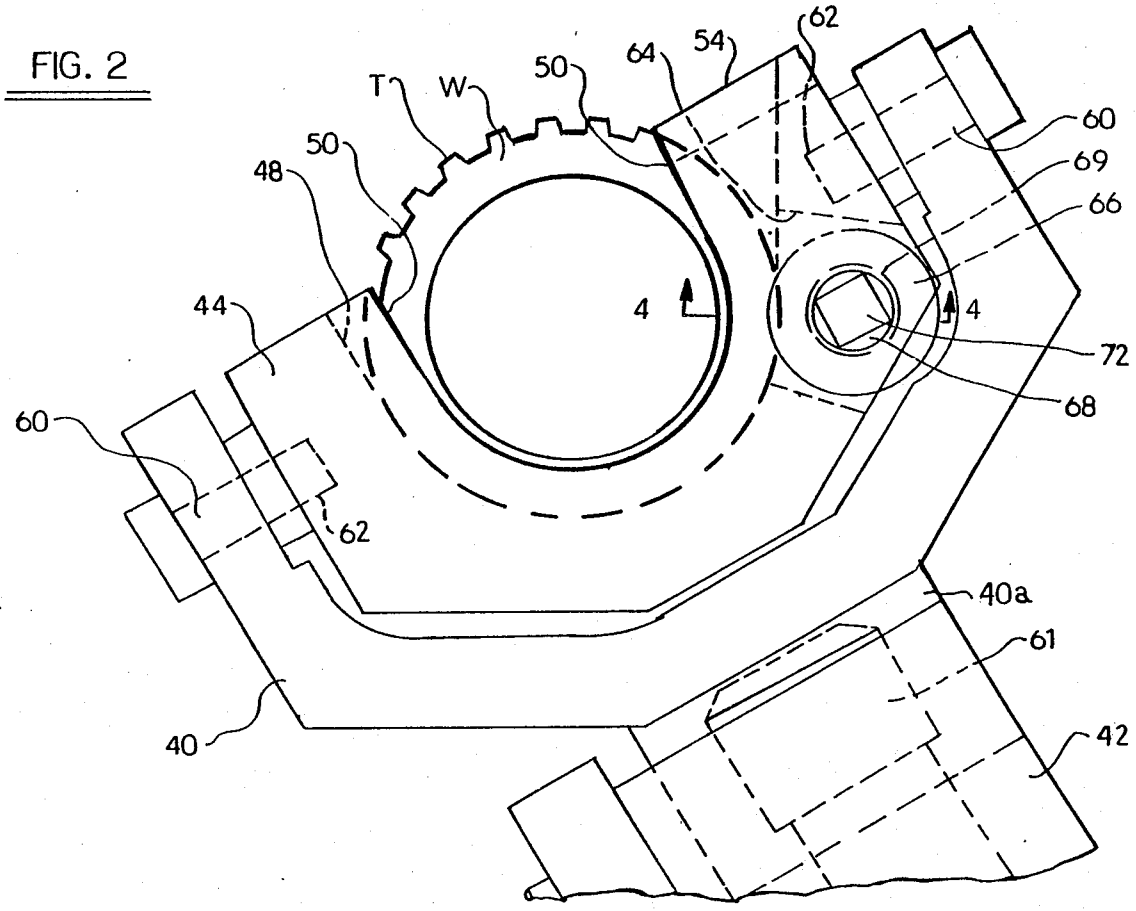
FIG. 2 is an enlarged view of the workpart fixturing means of the machine of FIG. 1.
Figure 3A:
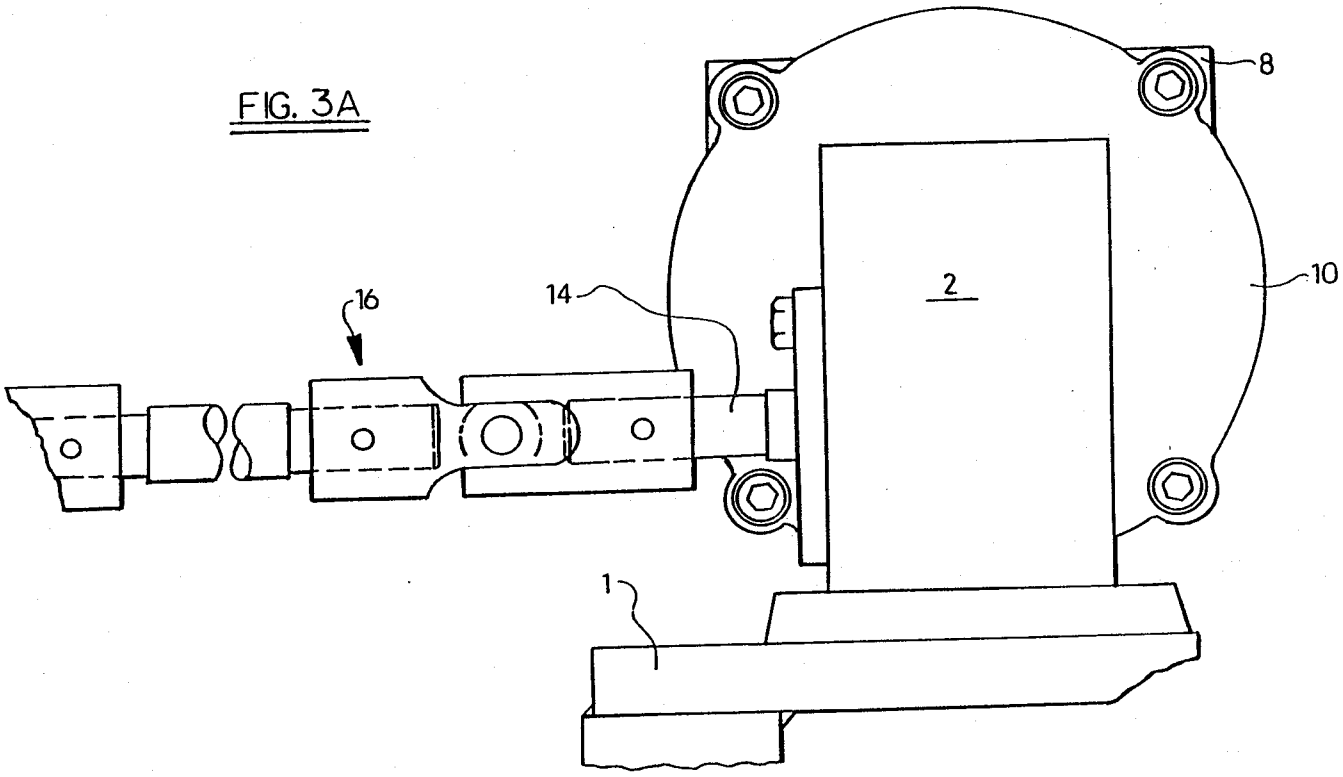
FIGS. 3A and 3B, when viewed together with coupling 16 connected, provide a partial side elevation of the machine of FIG. 1 with only one of the yoke members and associated workpart positioning assembly shown.
Figure 3B:
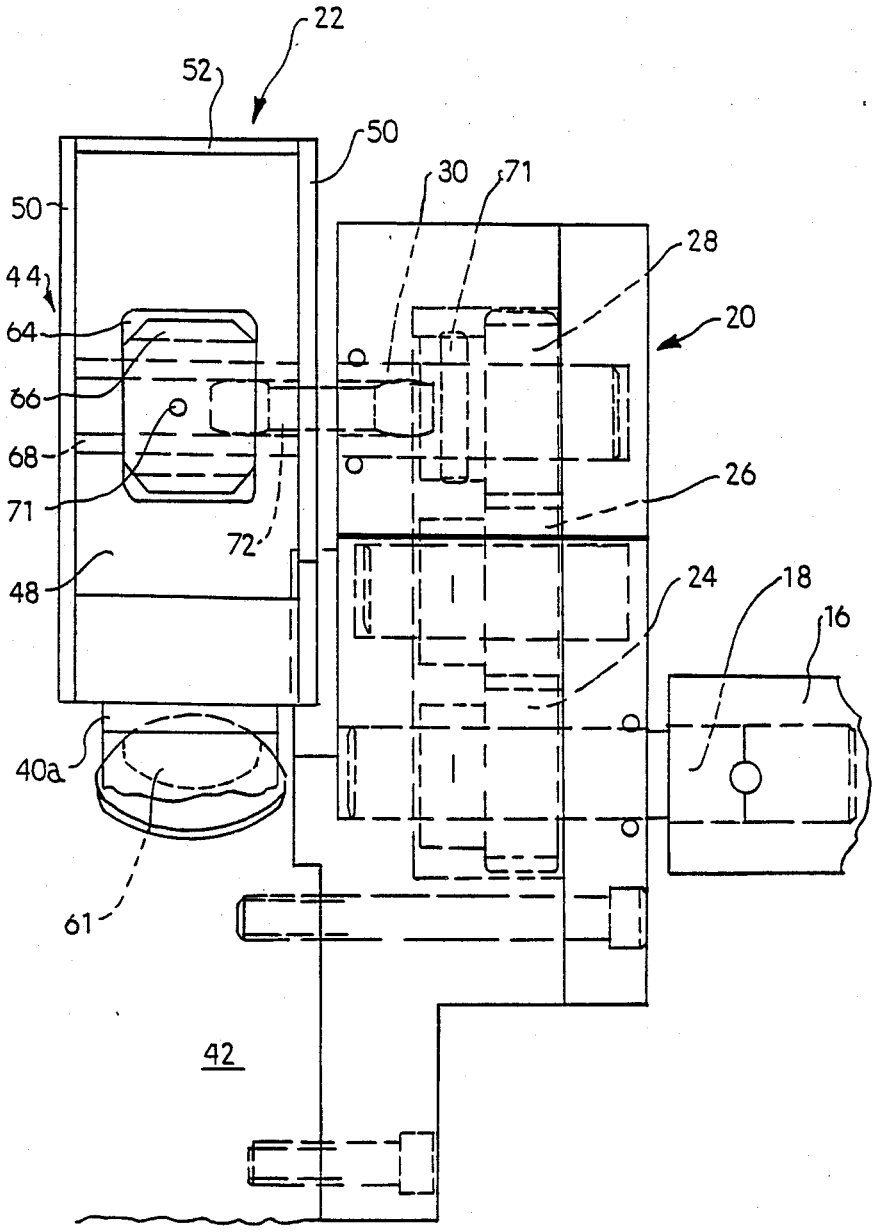

FIGS. 1–3 show a honing machine incorporating the fixturing means of the invention. In particular, the honing machine includes a base 1 on which a gear box 2 of an electric or fluid drive motor 4 is mounted by bolts 6 (one shown). The motor 4 is mounted on plate 8 which is attached to a plate 10 on the gear box housing 12. The gear box 2 includes an output shaft 14 in driving engagement with coupling 16. The coupling 16 is in driving engagement at the other end with a shaft 18 of a fixture driver 20 of the fixturing means 22. The fixture driver 20 includes toothed gears 24, 26, 28 meshed as shown to drive a hollow driver output shaft 30.

The workpart fixturing means is shown in FIG. 2 and includes a plurality of yoke members 40 pivotally attached to machine frame member 42 (only one shown).

Positioned in each yoke member 40 is a workpart positioning container or assembly 44 adapted to receive a workpart W in the pocket 48 thereof. Each container or assembly 44 has a pair of spaced thrust plates or walls 50 on opposite sides of the pocket 48 and having one side 54 open to receive and discharge the workpart. The container or assembly 44 may be machined from a solid plate as shown or formed of attached components. The workpart container 44 is suspended in the yoke member 40 by pins 60 received in oppositely disposed openings 62 in the containers. Each yoke member includes a neck 40*a* having a recess pivotably receiving pin 61 provided on the machine frame member 42. Thus, the containers 44 are free to float to allow the internal diameter of each workpart to align to a honing tool. The containers or assemblies 44 are thereby placed in stacked, floating relation for honing by a single tool 63.

As shown best in FIG. 2, each workpart container 44 includes a lateral access window 64 providing access of a workpart driving pinion gear 66 to and intermeshing with the workpart W. In particular, the external teeth 66*a* of the driving gear intermesh with the external teeth T of the workpart to drive same in rotation during the honing operation.

Figure 4:
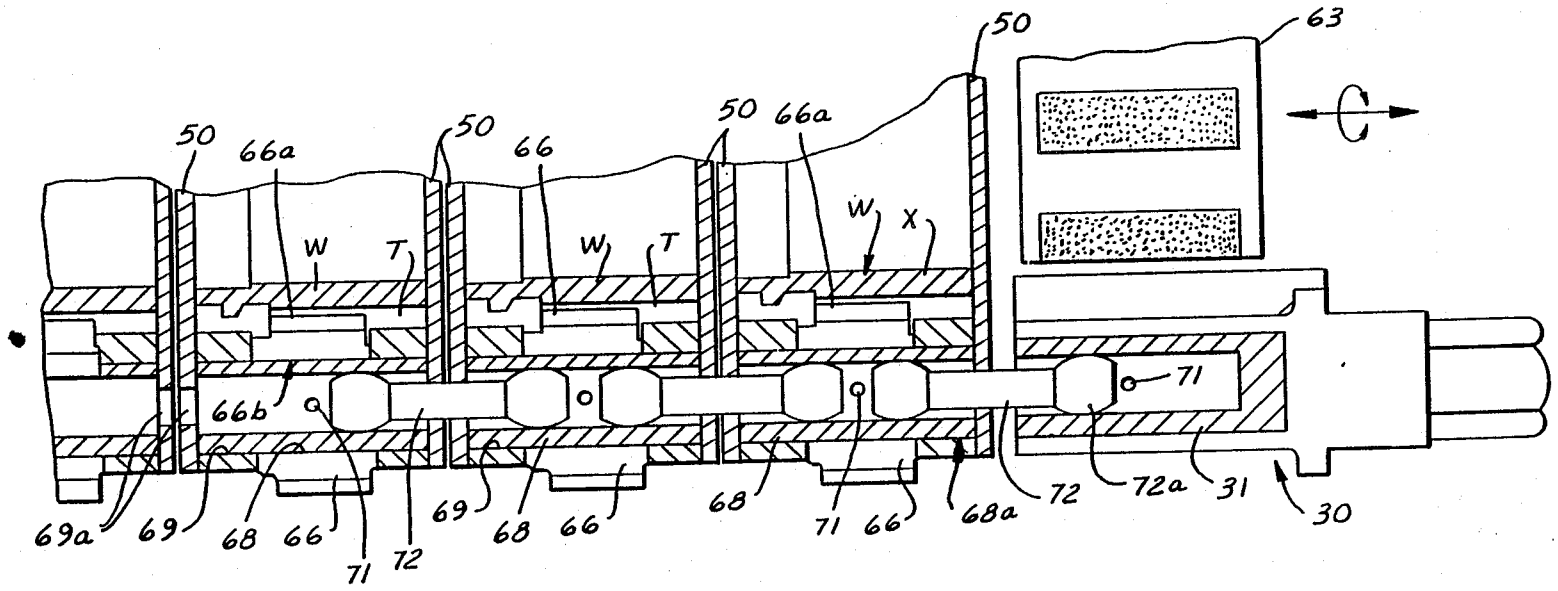
FIG. 4 is a partial longitudinal sectional view through the driving means of the fixturing means.
Figure 5:
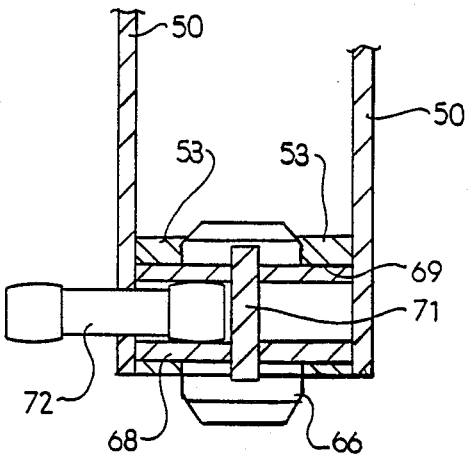
FIG. 5 is a partial longitudinal sectional view of one of the dog-bone drivers taken 90° to the view of FIG. 4.
Figure 6:
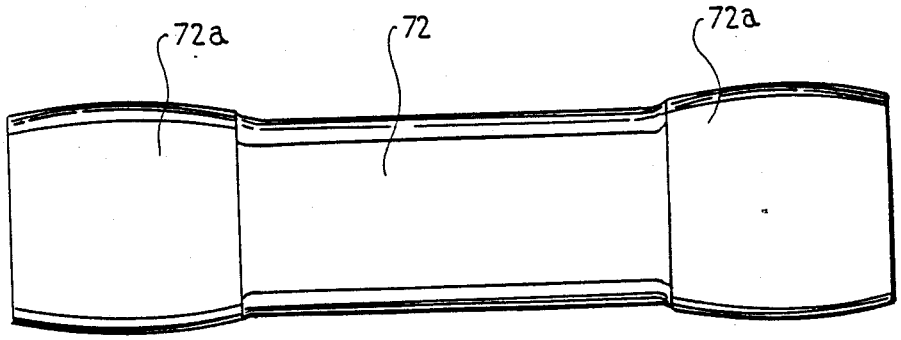
FIG. 6 is a side elevation of a dog-bone driver.

The workpart driving means is shown best in FIG. 4 and includes the individual driving gears 66 already referred to which are each mounted on individual bushings 68. That is, each driving gear includes a cylindrical bore 66*b* mounted on the outer cylindrical surface 68*a* of each bushing 68. The bushings 68 are each disposed in passages or apertures 69 through each assembly 44 and are rotatable in their respective assembly 44. A transverse pin 71 is press fit into the driver gear 66 and bushing 68 as shown in FIG. 5 to interconnect same.

Figure 8:
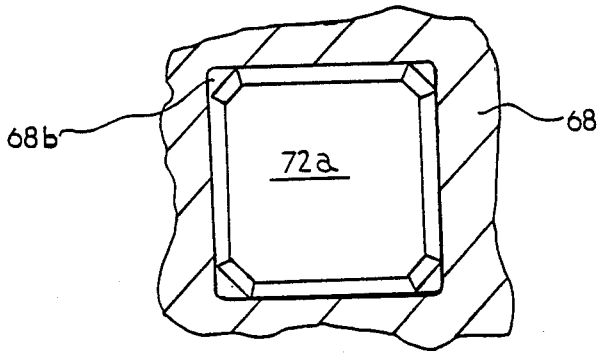
FIG. 8 is a similar elevation of the dog-bone driver received in the bushing in driving engagement.
Figure 7:
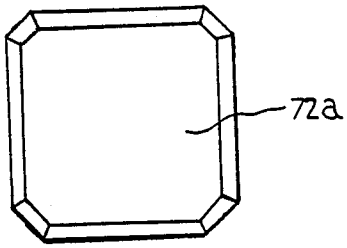
FIG. 7 is an end elevation of the dog-bone driver.

Positioned in driving engagement inside each bushing 68 are the ends of adjacent dog-bone shaped driver members 72. It is apparent that the dog-bone members 72 interconnect one bushing 68 and driver gear 66 thereon to the next adjacent sets of same through aligned apertures 69*a*. Driving engagement between the dog-bone driver member 72 and bushing 68 is effected by providing each end 72*a* of the dog-bone member with a polygonal shape, e.g., a square cross-section as shown in FIG. 7 and by providing the bushing 68 with a bore 68*b* of similar somewhat larger polygonal shape as shown in FIG. 8. It is apparent that when the dog-bone member 72 is rotated, bushing 68 and driver gear 66 thereon will be rotated. And, the dog-bone members of the shape shown allow the individual workparts W to align with the honing tool without interrupting driving engagement.

The transverse pin 71 connecting the bushing 68 and driver gear 66 extends between the facing ends 72*a* of the dog-bone members and limits axial movement of the dog-bone member 72 therein.

As shown in FIG. 4, the right-hand dog-bone member 72 in the figure has one end 72*a* drivingly received in bushing 31 in the hollow output shaft 30 of the fixture driver 20 and is located therein by transverse pin 71. The interior of bushing 31 has a square or polygonal shape similar to that of bushing 68. The opposite end of the right hand dog-bone member is drivingly received in the adjacent bushing 68. It is apparent that rotation of the output shaft 30 will cause the dog-bone members 72 to rotate in unison and cause bushings 68 and driver gears 66 thereon to also rotate in unison to drive the workparts W during the honing operation.

The workpart W illustrated in the figures may for example be an automotive transmission sun gear having a thin wall or web X beneath the teeth T and which as a result is torque sensitive during the honing operation, thus being prone to exhibit out-of-roundness of the internal diameter during honing in the prior art fixtures. For example, the sun gear may have an internal diameter slightly under 2.000 inches and a wall or web thickness X under the root or minor diameter of only about 0.170 inches which wall thickness is thinner in relation to the internal diameter than that previously associated with such automotive transmission sun gears.

Figure 9:
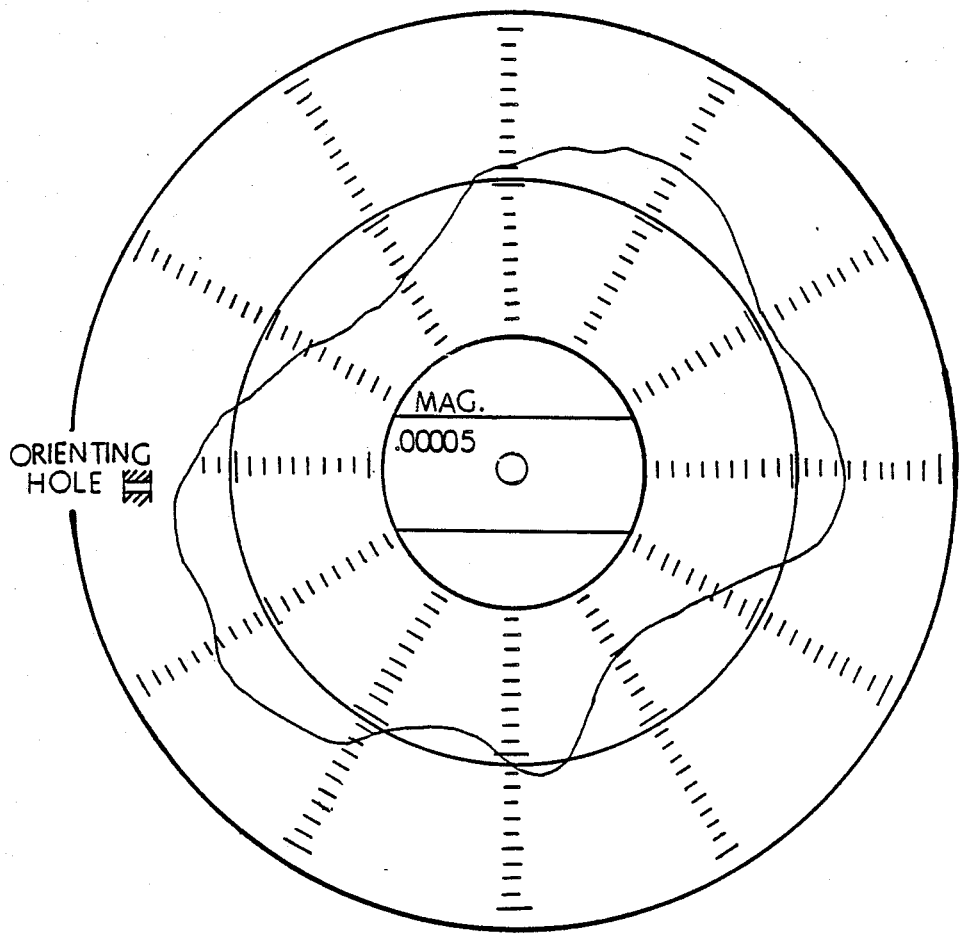
FIG. 9 is a surface trace showing roundness of the internal diameter of an automotive transmission sun gear prior to honing.
Figure 10:
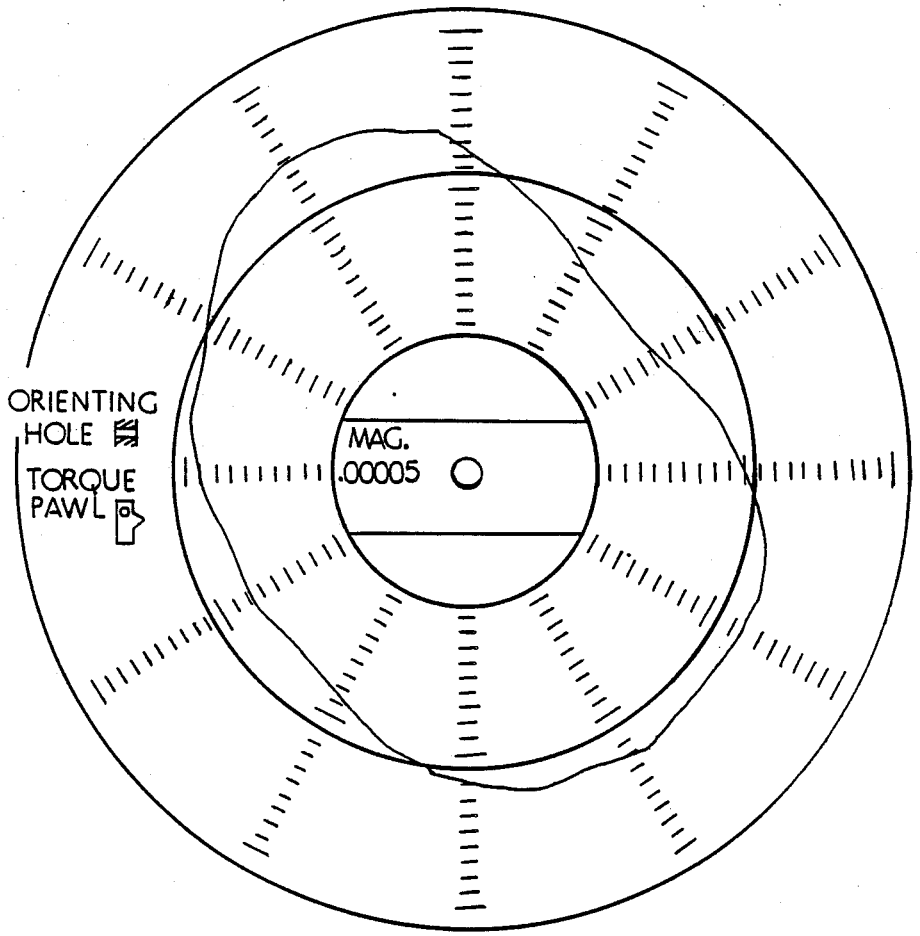
FIG. 10 is a similar trace after honing in a prior art fixture with a torque pawl located at the 9 o'clock position.
Figure 11:
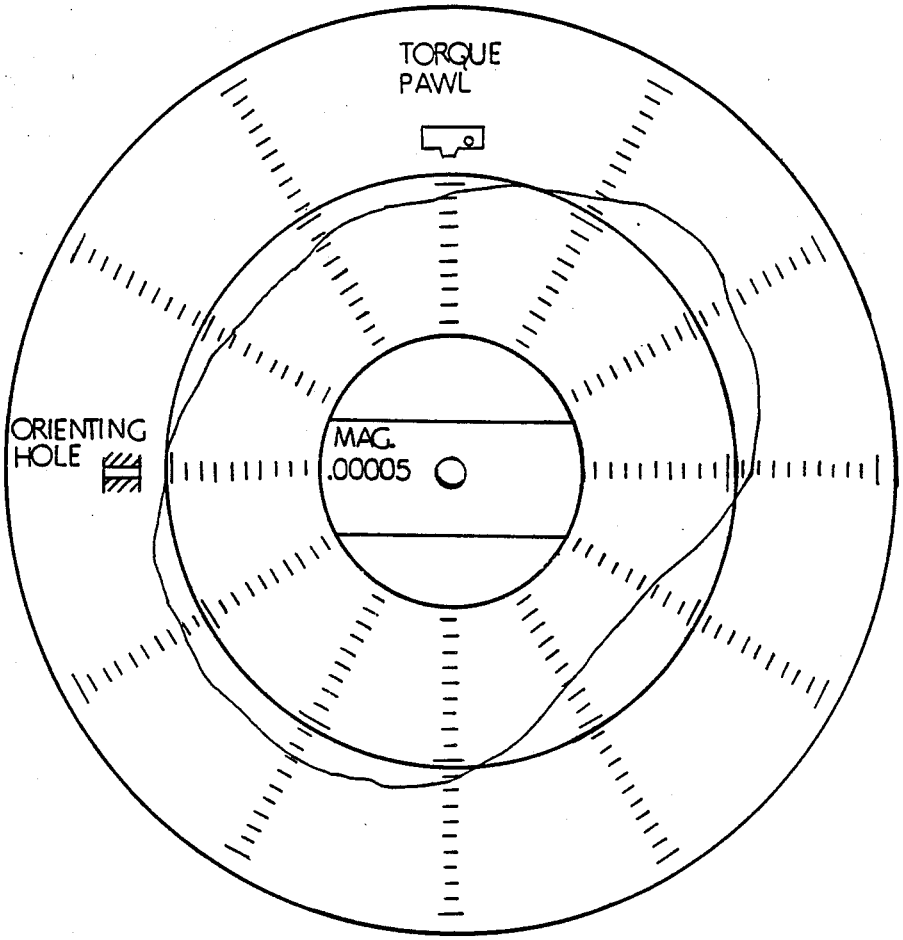
FIG. 11 is a similar trace after honing in the same prior art fixture with the torque pawl located at the 12 o'clock position.
Figure 12:
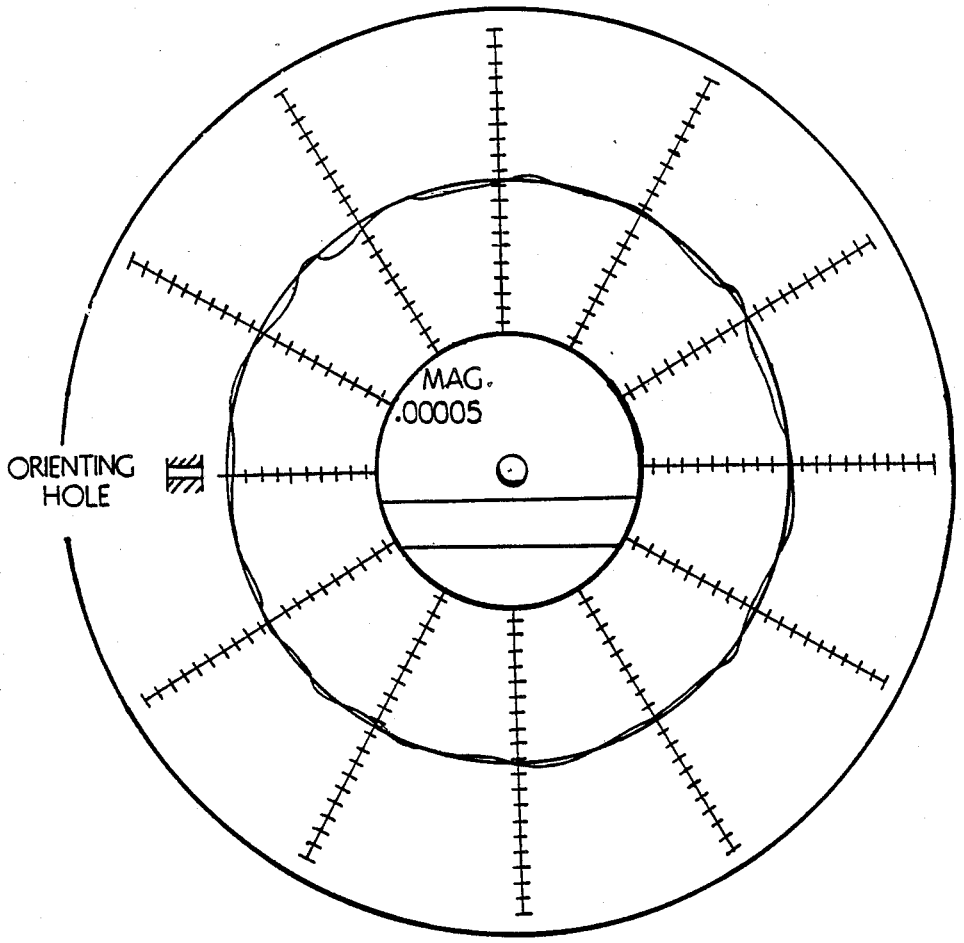
FIG. 12 is a similar trace after honing in the fixturing means of the invention with the workpart driven in rotation during honing.

FIG. 9 shows a trace of the roundness of the internal diameter of a typical sun gear of this type prior to honing. FIGS. 10 and 11 show a trace of the internal diameter of the gear after honing in the prior art fixture with the torque pawl engaged with the workpart at two different locations 90° from one another. A predictable out-of-roundness of the internal diameter is observed and relates to the location of the torque pawl as shown. FIG. 12 shows a similar sun gear after honing in the fixturing means of the invention with the workpart driven in rotation during honing. The substantial improvement in internal diameter roundness is evident.

The fixturing means of the invention is thus highly advantageous in improving internal diameter roundness in a thin wall annular workpart. The number of workparts capable of being honed can be varied as desired since the number of workpart containers and dog-bone drivers can be varied as desired. Furthermore, floating of the workpart fixture for alignment to the honing tool is not adversely affected.

While the fixturing means of the invention has been described by a detailed description of certain specific and preferred embodiments, it is understood that various modifications and changes can be made in them within the scope of the appended claims which are intended to include equivalents of such embodiments.

I claim:

1. A method for honing the internal diameter of a plurality of thin wall annular gear parts which are torque sensitive during honing and prone to out-of-roundness of the internal diameters after honing, comprising positioning the gear parts in stacked relation such that the internal diameter of each gear part can align itself to a honing tool, engaging each gear part with a driving gear, and reciprocating and rotating the honing tool through the internal diameters while concurrently driving each gear part individually in rotation by rotating each driving gear engaged therewith so as to minimize out-of-roundness of the honed internal diameters.

2. A method for honing the internal diameter of a thin wall annular gear part which is torque sensitive during honing and prone to out-of-roundness of the internal diameter after honing, comprising positioning the gear part relative to a honing tool such that the internal diameter can align to the tool, engaging the gear part with a single driving gear so as to allow aligning of the internal diameter to the honing tool during honing and reciprocating and rotating the tool through the internal diameter while concurrently driving the gear part in rotation by rotating said driving gear so as to minimize out-of-roundness of the honed internal diameter.

* * * * *